US005570808A

United States Patent [19]

Tassoni

[11] Patent Number: 5,570,808

[45] Date of Patent: Nov. 5, 1996

[54] DISPENSERS FOR PROTECTIVE GLOVES

[76] Inventor: Vincent A. Tassoni, 136-140 Roden Street, West Melbourne, Victoria 3003, Australia

[21] Appl. No.: 403,922

[22] PCT Filed: Sep. 23, 1992

[86] PCT No.: PCT/AU92/00504

§ 371 Date: Mar. 22, 1995

§ 102(e) Date: Mar. 31, 1995

[87] PCT Pub. No.: WO94/06329

PCT Pub. Date: Mar. 19, 1994

[51] Int. Cl.[6] ..... B65H 1/00

[52] U.S. Cl. ..... 221/34; 221/61; 221/63; 221/311

[58] Field of Search ..... 221/33, 34, 45, 221/46, 61, 62, 63, 303, 305, 311, 197

[56] References Cited

U.S. PATENT DOCUMENTS

| | | | |
|---|---|---|---|
| 1,999,021 | 4/1935 | Marsh | 221/311 |
| 3,184,104 | 5/1965 | De Domenico et al. | 221/311 |
| 4,844,293 | 7/1989 | McLaughlin | 206/278 |
| 4,993,589 | 2/1991 | McLaughlin | 221/59 |
| 4,997,105 | 3/1991 | Fischer | 221/63 |
| 5,042,687 | 8/1991 | McKinley | 221/45 |
| 5,088,620 | 2/1992 | Kelliher et al. | 221/59 |
| 5,265,785 | 11/1993 | Chudy | 206/278 |

FOREIGN PATENT DOCUMENTS

| | | | |
|---|---|---|---|
| 0305236 | 3/1989 | European Pat. Off. | 221/34 |
| 3144944 | 5/1983 | Germany | 221/46 |
| 404190490 | 7/1992 | Japan | 221/197 |

*Primary Examiner*—H. Grant Skaggs
*Attorney, Agent, or Firm*—Wolf, Greenfield & Sacks, P.C.

[57] ABSTRACT

A dispenser for loose, unpackaged protective gloves. A container has at least one compartment for holding a bulk quantity of gloves, and each compartment has a filling shaft with an upper filling opening to permit filling with the gloves. A dispensing portion at the lower end of the container protrudes forwardly from one side of the container. The dispensing portion has a dispensing shaft leading downwardly from the filing shaft for receiving gloves from the filling shaft, and top and bottom walls providing a top and bottom, respectively, to the dispensing shaft and which slope downwardly and forwardly from the filling shaft. An end wall is spaced from the compartment and extends between the top and bottom walls, with a dispensing opening into the inclined dispensing shaft extending within part of each of the end and top walls. The dispensing opening prevents gloves in the compartment from inadvertently passing through the opening but is shaped and sized to permit the insertion of a user's fingers into the dispensing shaft for gripping individual gloves and withdrawing them through the dispensing opening.

10 Claims, 5 Drawing Sheets

DISPENSERS FOR PROTECTIVE GLOVES

BACKGROUND OF THE INVENTION

The present invention relates to a dispenser for protective, medical or other protective gloves, and more particularly to the dispenser for dispensing gloves of different size, as well as a dispensing system incorporating the dispenser and at least one package of the gloves.

SUMMARY OF THE INVENTION

According to one aspect of the present invention, there is provided a dispenser for dispensing loose, unpackaged protective gloves, including: a container having at least one compartment with a filling opening at an upper end thereof to permit filling of a bulk quantity of loose, unpackaged protective gloves into the compartment, and a dispensing portion at a lower end of the container and having a dispensing opening into the compartment through which the gloves are dispensed, the dispensing portion being configured so as to present loose gloves within the compartment to the dispensing opening for dispensing therethrough, the dispensing opening being positioned laterally to one side of the compartment so as to prevent gloves in the compartment from inadvertently passing through the opening but shaped and sized to permit the insertion of a user's fingers into the dispensing portion for gripping individual gloves and withdrawing them through the dispensing opening.

According to another aspect of the present invention, there is provided a dispensing system for protective gloves, including the above dispenser and at least one package containing a bulk quantity of protective gloves for dispensing from the dispenser, the package being operable for supplying loose, unpackaged gloves to the or a respective compartment for subsequent removal therefrom through the dispensing opening.

BRIEF DESCRIPTION OF THE FIGURES

Embodiments of the invention will now be described by way of example only with reference to the accompanying drawings in which.

DETAILED DESCRIPTION

Figure 1:
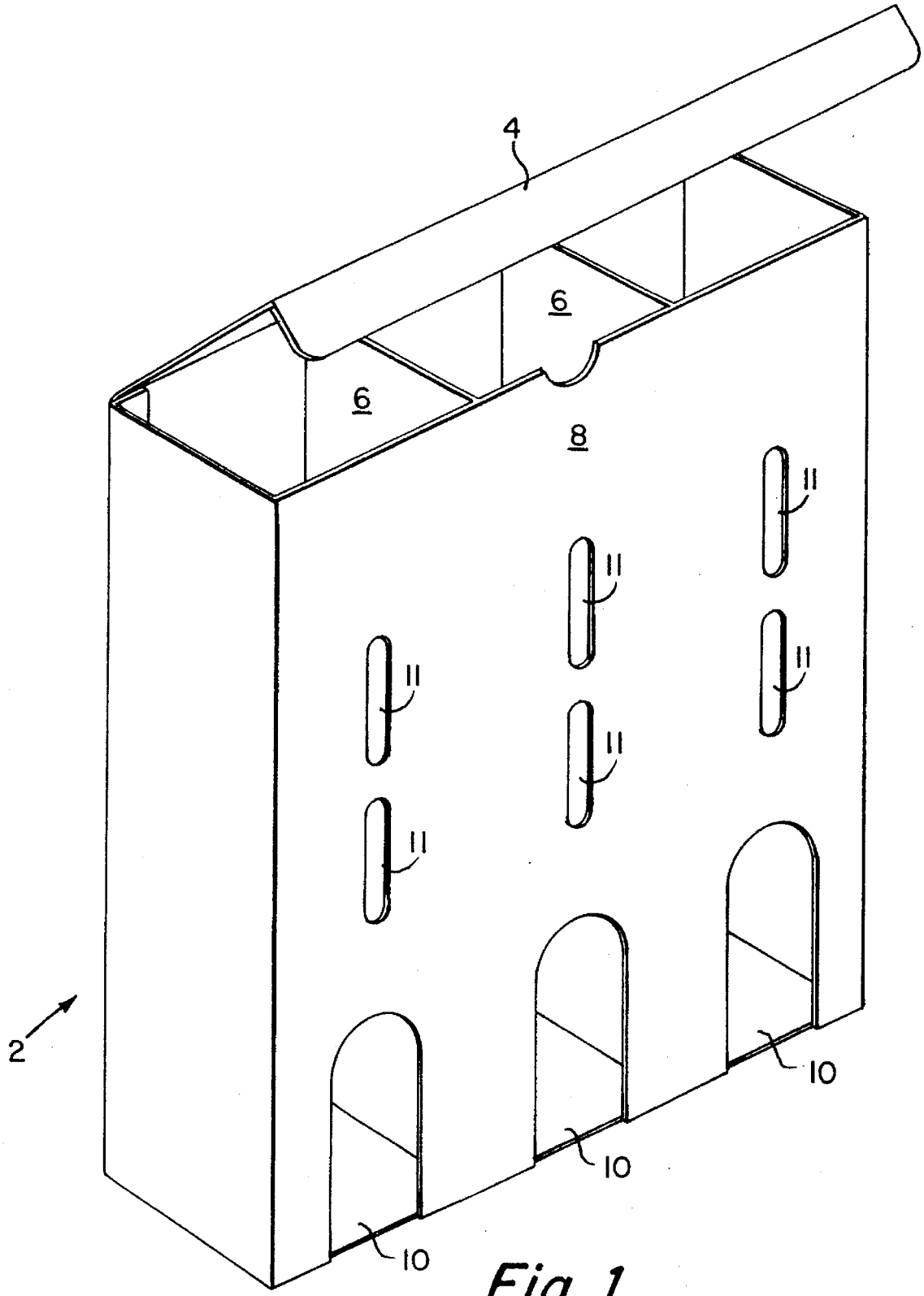
FIG. 1 is a perspective view of a dispenser for protective gloves.

The dispenser shown in FIG. 1 is in the form of a rectangular container 2 having an open upper end which is closable by means of a lid 4. The interior of the container is divided into several compartments by parallel partitions 6 extending vertically between the front and rear walls of the container. In the particular form shown there are three such compartments and each compartment extends vertically along the height of the container 2. The front wall 8 of the container includes dispensing apertures 10 each opening from a respective one of the compartments, the aperture 10 being at the bottom of the associated compartment. In use, each of the compartments is filled with protective gloves (typically made of thin latex) through the upper end of the container, the gloves being supplied in a bulk package which can be opened and its contents tipped into the upper end of the compartment. Each compartment contains gloves of a different size. Removal of the gloves is effected through the aperture 10 at the lower end of the compartment. When the gloves have been tipped into the compartment, portions of the lowermost gloves will tend to project through the dispensing apertures 10 and can thus be readily grasped and removed when required for use. One or more windows 11 are formed in the front wall of each compartment to permit visual inspection of the amount of product in each compartment to facilitate replenishment when required.

The dispenser may be fabricated in cardboard or plastics sheet material by folding a suitable blank or may be injection moulded in suitable plastics material.

Figure 2:
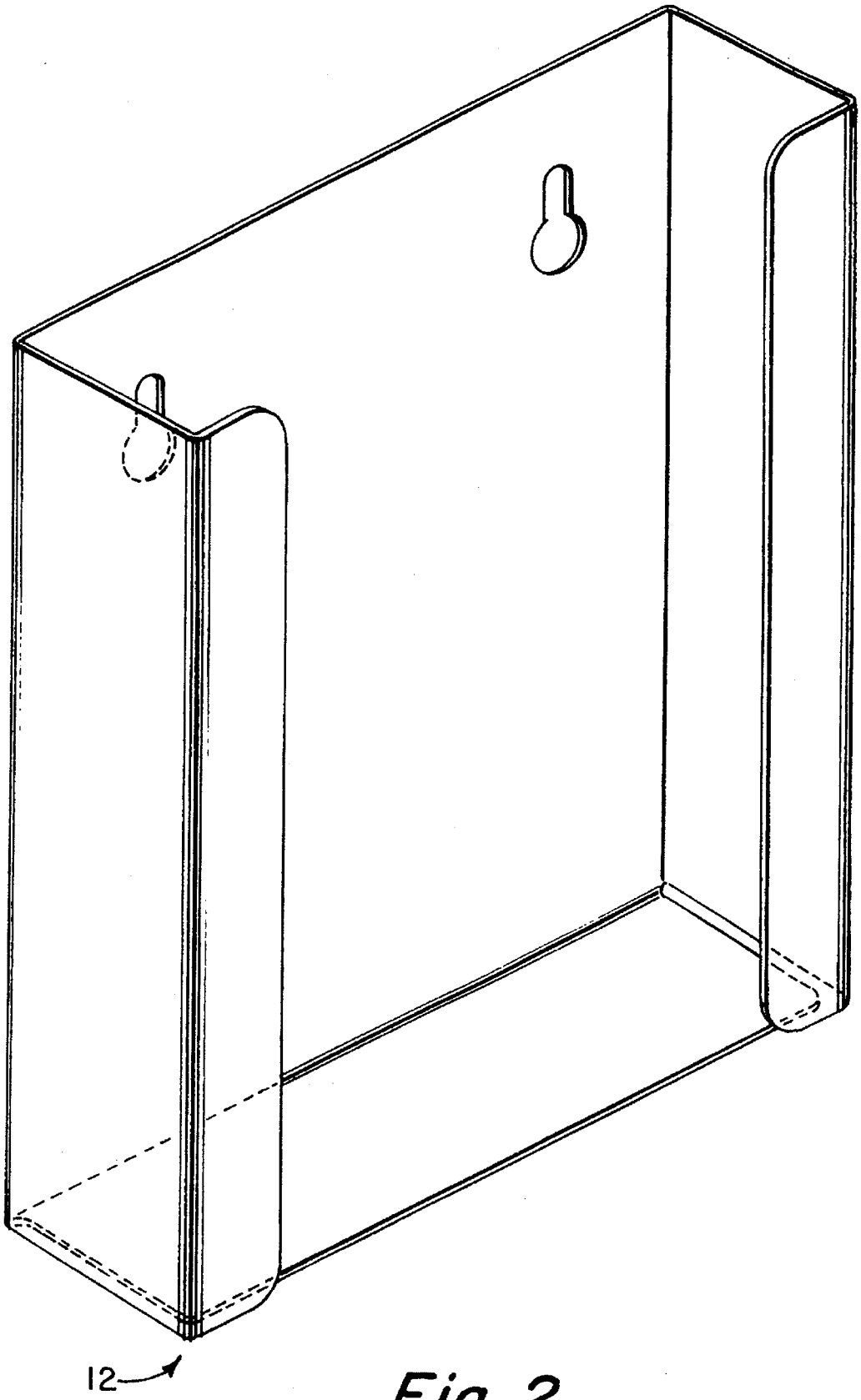
FIG. 2 is a perspective view of a wall bracket for mounting the dispenser of FIG. 1.

The dispenser may be mounted on the wall by means of a wall bracket 12 shown in FIG. 2 in which the dispenser is removably fitted.

Figure 3:
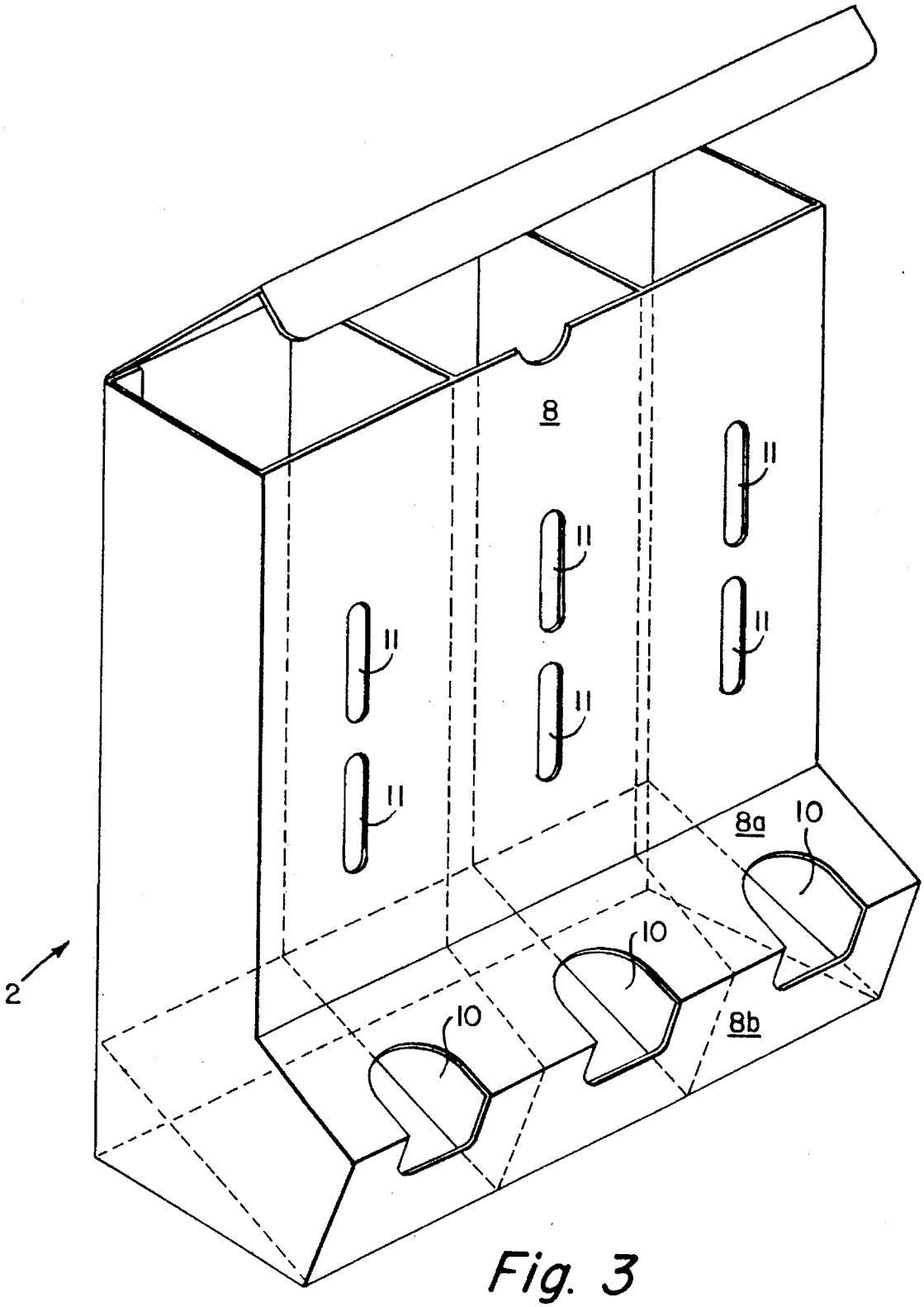
FIG. 3 is a perspective view of a preferred embodiment of the dispenser in accordance with the present invention.

The preferred embodiment dispenser shown in FIG. 3 is generally similar to the dispenser shown in FIG. 2 except that the lower portion of the container including the dispensing apertures 10 is enlarged to provide a deeper base which enables the dispenser to act as a free-standing unit which may be kept on a desk or table. In this preferred embodiment, the enlargement of the base is effected by extending the lower part of the front wall 8 with a portion **8*a* directed outwardly and downwardly and a further portion extending downwardly 8*b*. The dispensing apertures 10** are formed in a zone adjacent the junction of the two wall portions in order to permit a hand easily to be inserted into the aperture from above and thereby to facilitate removal of the glove through the dispensing aperture. The bottom of each compartment preferably slopes towards the front in order to cause the contents to move towards the dispensing apertures. If the configuration of the free-standing unit is such that the unit might topple over when stood on a desk, this tendency can be counteracted by making the dispenser of weight such that it will not easily topple over when stood on a desk and this can be achieved by fabricating the dispenser by injection moulding from a suitable plastics, or by fabricating the dispenser from metal sheet, such as stainless steel sheet. The relative depth of the base and height of the dispenser will also influence the toppling characteristics and these dimensions can be such as to minimise the risk of toppling.

The dispenser of FIG. 3 can be fabricated relatively inexpensively by folding cardboard or plastics sheet material. The exterior of the container can be fabricated from a single blank of the sheet material which is shaped, and folded to form all of the external walls, including the front, rear, and side walls, the lid, and the base formed by wall portions **8*a*,8*b*. The individual compartments are each defined by separately formed tubes of rectangular cross-section mounted within the exterior container. Each tube is itself formed from a separate one-piece blank, folded into tubular shape. The bottom edge of the tube is perpendicular to the axis of the tube so that the tube rests on the bottom wall of the exterior container, and at its lower end portion the tube includes an integral ramp formed by a flap, which slopes forwardly and downwardly from a position above the bottom edge of the tube to form the sloping bottom of the compartment in order to direct gloves towards the associated aperture 10** in the external container.

Figure 4A:
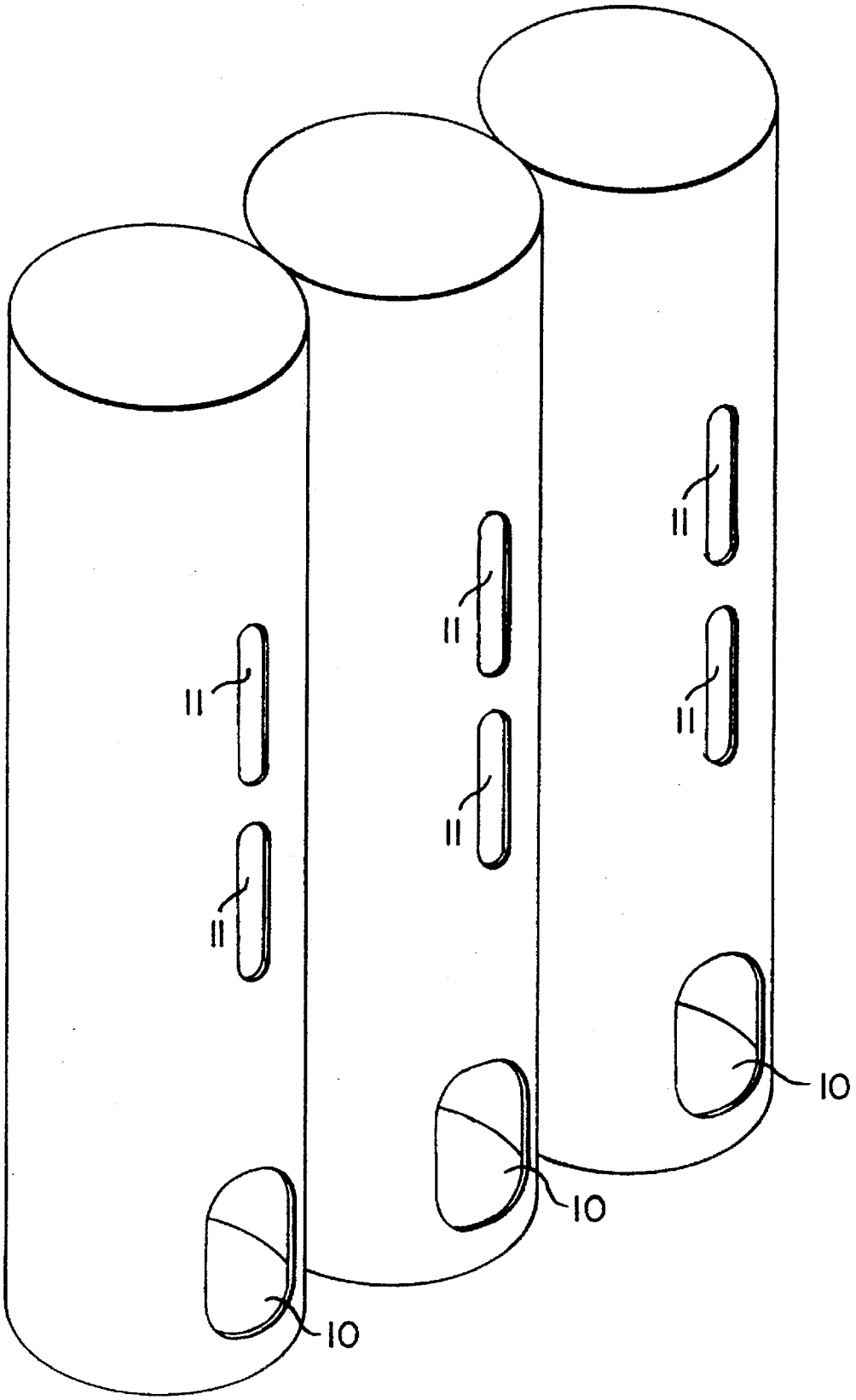
FIG. 4A is a perspective view of another dispenser for protective gloves.

In another dispenser shown in FIG. 4A, the dispenser is formed from a group of plastics pipes secured in side-byside relation to define respective compartments. The pipes are open at their upper ends to provide filling apertures and dispensing apertures 10 are provided at the lower ends of the pipes. Inspection windows 11 are also provided.

Figure 4B:
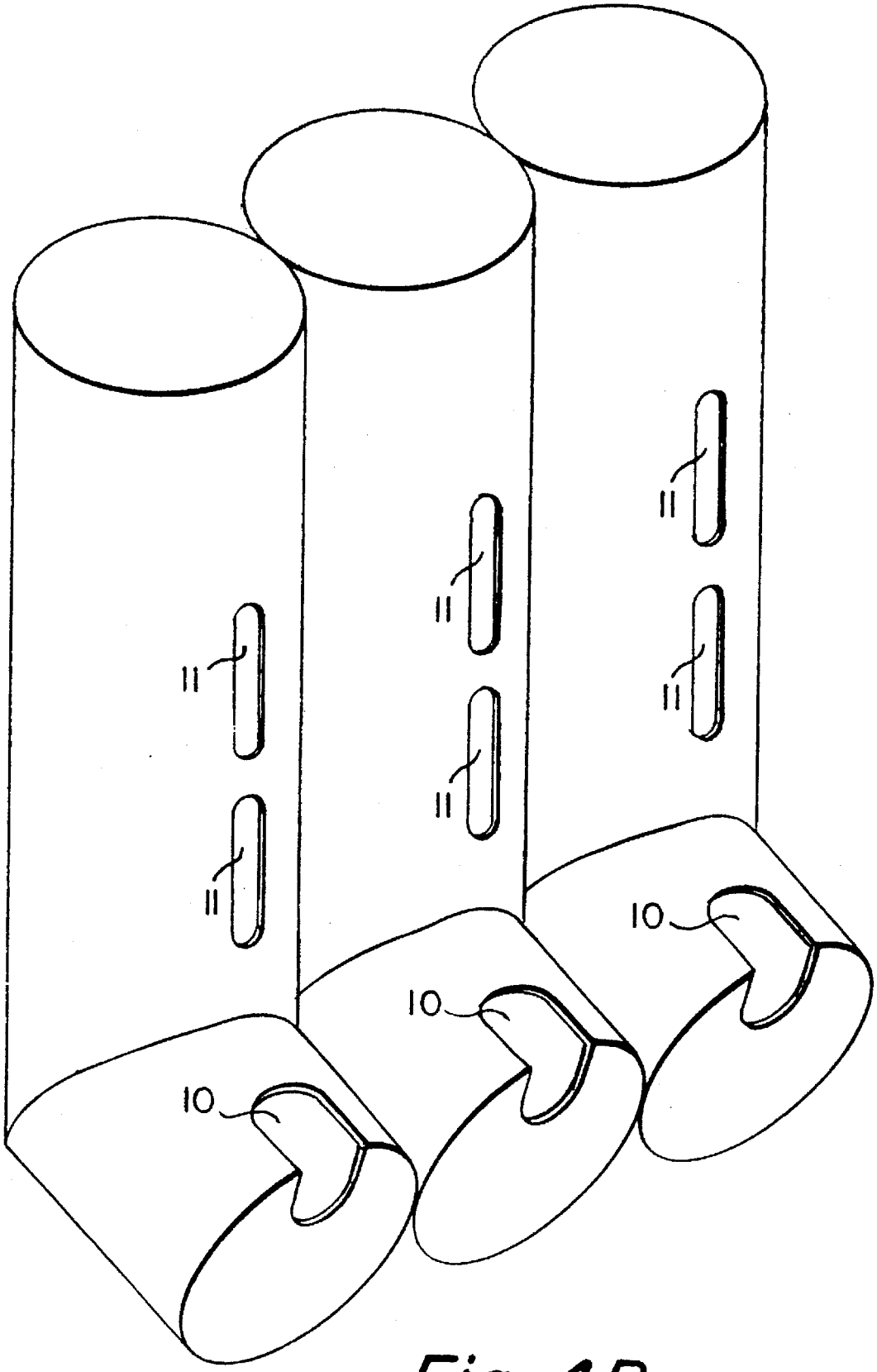
FIG. 4B is a perspective view of a further preferred embodiment of the dispenser in accordance with the present invention.

In a further preferred embodiment shown in FIG. 4B the dispenser of FIG. 4A is modified so that the bottom portion of each pipe is forwardly and downwardly directed to define a dispensing portion including the dispensing aperture.

In each of the dispensers disclosed, the dispensing apertures 10 each have a concave or arched upper edge. This configuration has been found to prevent tearing of the gloves as they are withdrawn.

Dispensers with three compartments have been described by way of example only. When a particular dispenser is designed for a range of gloves having more than three sizes, the dispenser will have a separate compartment for each size of glove.

The embodiments have been described by way of example only and modifications are possible within the scope of the invention.

I claim:

1. A dispenser for dispensing loose, unpackaged protective gloves, comprising:

(a) a container with at least one compartment for holding a bulk quantity of loose, unpackaged protective gloves, each compartment having a filling shaft with a filling opening at an upper end thereof to permit filling of the filling shaft with the gloves, the filling shaft extending downwardly from the filling opening to a lower end thereof, and (b) a dispensing portion at the lower end of the container, the dispensing portion protruding forwardly from one side of the container and having (i) a dispensing shaft leading from and being downwardly inclined from the filling shaft for receiving gloves from the filling shaft, (ii) a bottom wall providing a bottom to the dispensing shaft and which slopes downwardly and forwardly from the filling shaft, (iii) a top wall providing a top to the dispensing shaft and which slopes downwardly and forwardly from the filling shaft, (iv) an end wall spaced from the compartment and extending between the top and bottom walls, and (v) a dispensing opening into the inclined dispensing shaft through which gloves in the compartment are dispensed, the dispensing opening extending within part of each of the end and top walls, the dispensing portion presenting loose gloves within the filling shaft to the dispensing opening for dispensing therethrough, the dispensing opening being positioned so as to prevent gloves in the compartment from inadvertently passing through the opening but shaped and sized to permit the insertion of a user's fingers into the dispensing shaft for gripping individual gloves and withdrawing them through the dispensing opening.

2. A dispenser as claimed in claim 1, wherein the filling shaft extends vertically from the filling opening to the dispensing portion.

3. A dispenser as claimed in claim 2, wherein the filling shaft is of constant cross sectional shape and size throughout its length, the axis of the filling shaft being rectilinear.

4. A dispenser as claimed in claim 1, wherein the top, bottom and end walls are planar.

5. A dispenser as claimed in claim 1, wherein the dispensing opening has arched upper and lower edges.

6. A dispenser as claimed in claim 1, and further comprising at least one window in a wall of the compartment to permit visual inspection of the glove contents within the compartment.

7. A dispenser as claimed in claim 1, wherein the dispenser is formed from folded sheet material.

8. A dispenser as claimed in claim 1, wherein three said compartments are provided, the respective compartments intended to contain a different size of glove.

9. A dispenser for dispensing loose, unpackaged protective gloves, comprising:

(a) a container with at least one compartment for holding a bulk quantity of loose, unpackaged protective gloves, each compartment having a filling shaft with a filling opening at an upper end thereof to permit filling of the filling shaft with the gloves, the filling shaft extending downwardly from the filling opening to a lower end thereof, and (b) a dispensing portion at the lower end of the container, the dispensing portion protruding forwardly from one side of the container and having (i) a dispensing shaft leading from and being downwardly inclined from the filling shaft for receiving gloves from the filling shaft, (ii) a bottom wall providing a bottom to the dispensing shaft and which slopes downwardly and forwardly from the filling shaft, (iii) a top wall providing a top to the dispensing shaft, (iv) an end wall spaced from the compartment and extending between the top and bottom walls, and (v) a dispensing opening in the end wall into the inclined dispensing shaft through which gloves in the compartment are dispensed, the dispensing portion presenting loose gloves within the filling shaft to the dispensing opening for dispensing therethrough, the dispensing opening being positioned so as to prevent gloves in the compartment from inadvertently passing through the opening but shaped and sized to permit the insertion of a user's fingers into the dispensing shaft for gripping individual gloves and withdrawing them through the dispensing opening.

10. A dispenser for dispensing loose, unpackaged protective gloves, comprising:

(a) a container with at least one compartment for holding a bulk quantity of loose, unpackaged protective gloves, each compartment having a filling shaft with a filling opening at an upper end thereof to permit filling of the filling shaft with the gloves, the filling shaft extending downwardly from the filling opening to a lower end thereof, and (b) a dispensing portion at the lower end of the container, the dispensing portion protruding forwardly from one side of the container and having (i) a dispensing shaft leading from and being downwardly inclined from the filling shaft for;receiving gloves from the filling shaft, (ii) a bottom wall providing a bottom to the dispensing shaft and which slopes downwardly and forwardly from the filling shaft, (iii) a top wall providing a top to the dispensing shaft, (iv) an end wall spaced from the compartment and extending between the top and bottom walls, and (v) a dispensing opening in the top wall into the inclined dispensing shaft through which gloves in the compartment are dispensed, the dispensing portion presenting loose gloves within the filling shaft to the dispensing opening for dispensing therethrough, the dispensing opening being position so as to prevent gloves in the compartment from inadvertently passing through the opening but shaped and sized to permit the insertion of a user's fingers into the dispensing shaft for gripping individual gloves and withdrawing them through the dispensing opening.

* * * * *